United States Patent [19]

Gentry et al.

[11] Patent Number: 4,625,469

[45] Date of Patent: Dec. 2, 1986

[54] REPLACEMENT FLAT ROOF INSULATION COVER

[76] Inventors: Thomas H. Gentry, 79 Bay Woods Dr., Clearwater, Fla. 33572; Robert W. Mays, 2025 Roger St., Clearwater, Fla. 33546

[21] Appl. No.: 796,830

[22] Filed: Nov. 12, 1985

[51] Int. Cl.[4] ..... E04D 13/16

[52] U.S. Cl. ..... 52/3; 52/60; 52/96; 52/410; 52/747

[58] Field of Search ..... 52/3, 22, 90, 60, 96, 52/408, 409, 74, 410, 478, 486, 489, 518, 520, 522, 94, 404, 514, 309.8, 741, 747, 748, 716–718, 222, 63; 411/368, 369, 371, 531, 542

[56] References Cited

U.S. PATENT DOCUMENTS

| | | | |
|---|---|---|---|
| 3,388,523 | 6/1968 | Evans | 52/717.1 |
| 3,783,564 | 1/1974 | Dunn et al. | 52/74 X |
| 3,895,467 | 1/1975 | Clement | 52/60 X |
| 4,162,597 | 7/1979 | Kelly | 52/410 |
| 4,320,605 | 3/1982 | Carlson et al. | 52/410 X |
| 4,333,660 | 6/1982 | Cupit | 52/60 X |
| 4,361,997 | 7/1982 | DeCaro | 52/410 X |
| 4,385,474 | 5/1983 | Earley | 52/3 X |
| 4,476,660 | 10/1984 | Francovitch | 411/542 X |
| 4,519,172 | 5/1985 | Ristow | 52/410 X |

FOREIGN PATENT DOCUMENTS

| | | | |
|---|---|---|---|
| 2051910 | 1/1981 | United Kingdom | 52/410 |

*Primary Examiner*—William F. Pate, III
*Assistant Examiner*—Richard Chilcot
*Attorney, Agent, or Firm*—Herbert W. Larson; Joseph C. Mason, Jr.

[57] ABSTRACT

Roof replacement structure for flat roof building having panels of rigid insulation applied over the roof surface. A flexible membrane is applied over the rigid insulation and a periphery of the membrane overlapping a side of the building is fastened thereto with a termination bar.

10 Claims, 12 Drawing Figures

REPLACEMENT FLAT ROOF INSULATION COVER

TECHNICAL FIELD

This invention relates to roof structures. More particularly, it refers to an insulated membrane covered roof structure for use in replacing defective roofs on mobile homes and low pitch gravel roofs.

BACKGROUND ART

Roofing systems for flat roof structures are well known as shown by U.S. Pat. Nos. 4,045,922; 4,162,597 and 4,424,650. These systems provide adequate covering for flat roofs, but tend to be expensive to install. A roofing system is needed which will provide a replacement roof for roofs with split seams, rusted surfaces, poor insulating properties or leaking joints, but at a low cost to accommodate the modest income level of many mobile home owners.

SUMMARY OF THE INVENTION

We have invented a novel replacement roofing system that combines the efficiency of selected roofing components with advanced installation techniques resulting in a low cost long lasting roof.

The replacement roof system is installed by mechanically fastening rigid insulation panels to the flat surface of the old roof. The panels are held down by fastening plates installed at strategic locations where corners of two or more insulation panels touch. A flexible water impervious membrane is thereafter affixed with mechanical fasteners through the panels of rigid insulation to the old metal roof and the flexible membrane is overlapped and heat sealed on top of the mechanical fasteners. A portion of the flexible membrane is allowed to overlap the upper portion of the sidewall intersecting with the roof and is mechanically fastened to the sidewall with a termination insert bar having a first and second leg.

BRIEF DESCRIPTION OF THE DRAWINGS

The present invention may be further understood by those having ordinary skill in the art by reference to the following detailed description together with the accompanying drawings in which.

DETAILED DESCRIPTION OF THE PREFERRED EMBODIMENT

Figure 1:
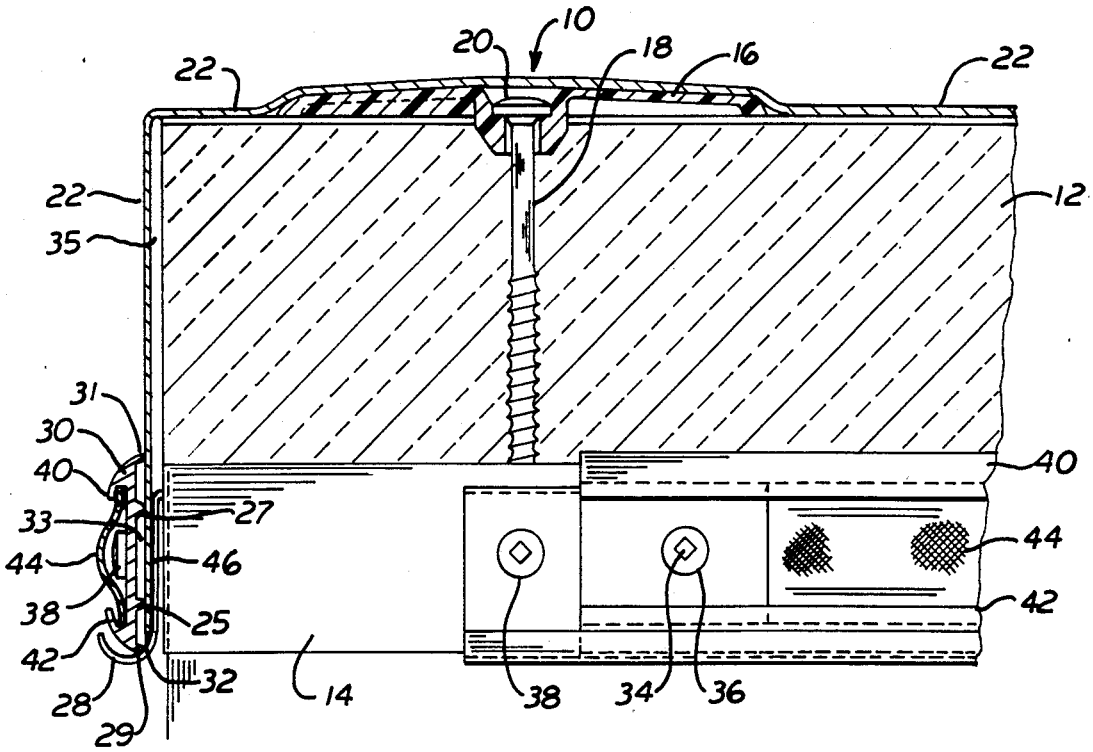
FIG. 1 is an elevation view of the roof structure in section.

Referring to FIG. 1, the roof replacement structure 10 includes blocks of rigid insulation 12 laid over an old roof 14 so that each block 12 touches an adjacent block 12. At the intersection of two or more insulation blocks 12, or at the corner of a block a fastening plate 16 is installed. A screw 18 with head 20 holds the fastening plate 16 in place. The screw 18 is drilled down between the insulation blocks or through a block into the old roof 14. The old roof 14 is completely covered with the rigid insulation blocks 12. After the insulation blocks 12 are securely in place, a water impermeable membrane 22 about 35 mm. thick such as one made from an ethylene interpolymer 22 is rolled over the insulation blocks 12 to cover the entire top flat side of the roof and overlap each side of the roof to a distance of about one foot, (30.48 cm.).

Figure 4:
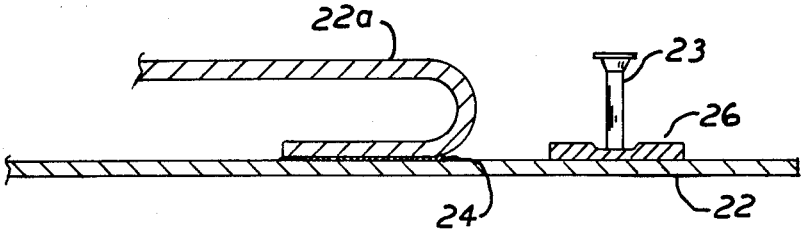
FIG. 4 is a sectional view of the membrane cover before being rolled out.
Figure 5:
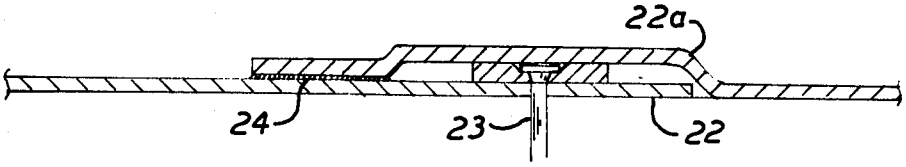
FIG. 5 is a sectional view of the membrane cover after being rolled out.
Figure 6:
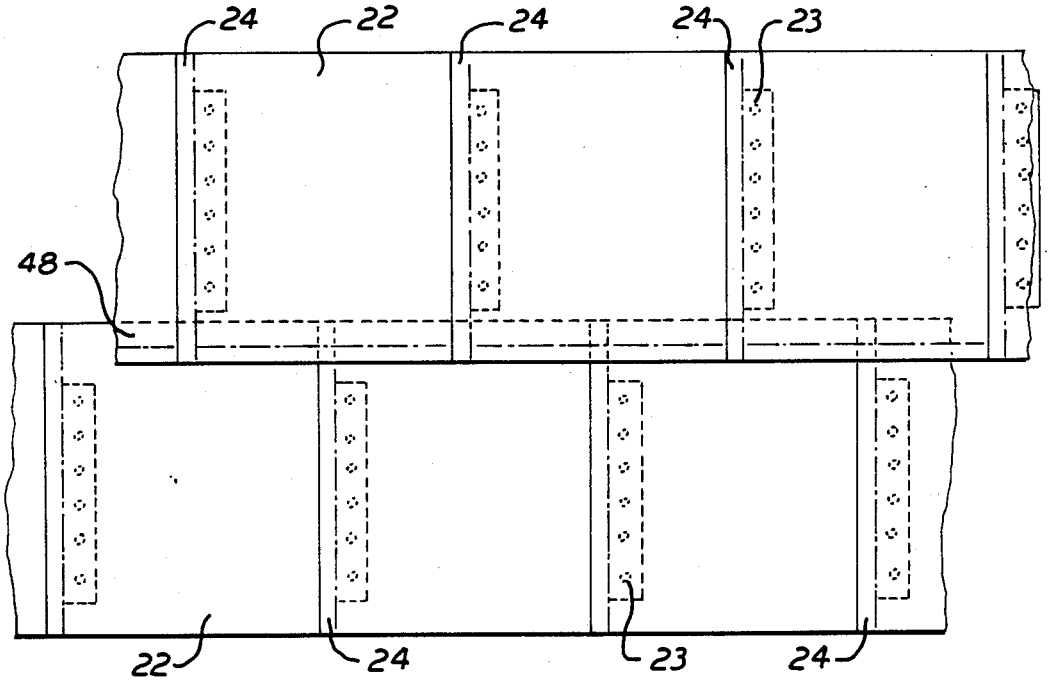
FIG. 6 is a plan view of the membrane cover in place with the heat welding strip shown in phantom.

The membrane 22 is held down in a pattern shown in FIGS. 4–6. A screw 23 is inserted through a round 2 inch steel plate 26 and through the membrane 22 into the old roof. An extension of the membrane 22*a* is heat welded 24 to the membrane 22 and then is overlapped over screw 23 so that the screw is not exposed to the air.

Figure 8:
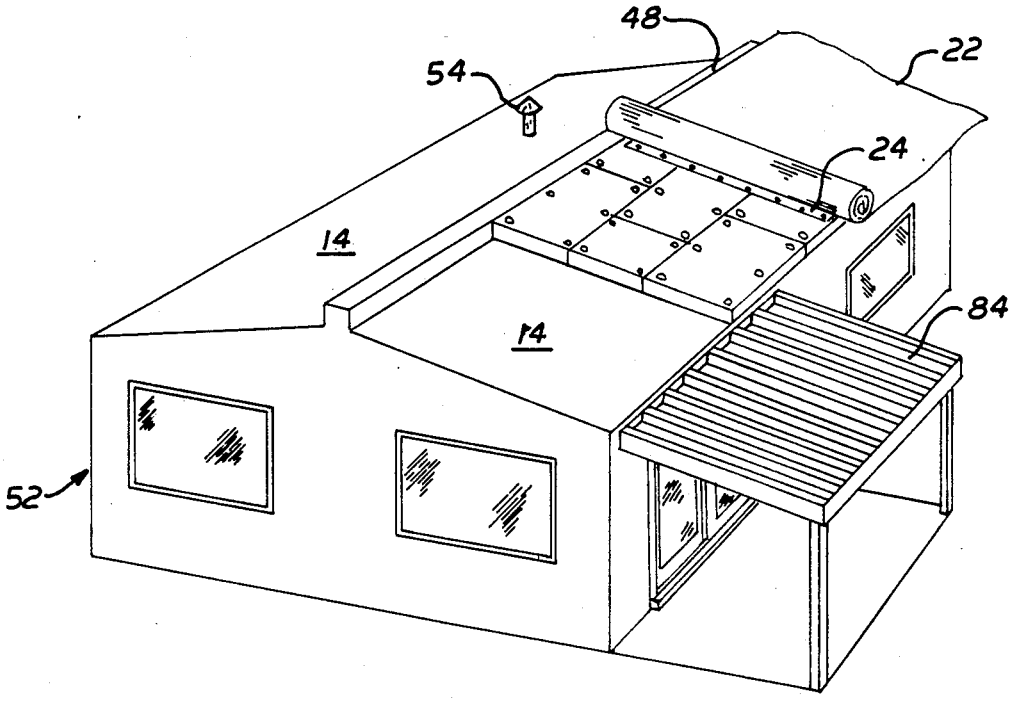
FIG. 8 is a perspective view of the roof structure being applied to a two unit mobile home.
Figure 9A:
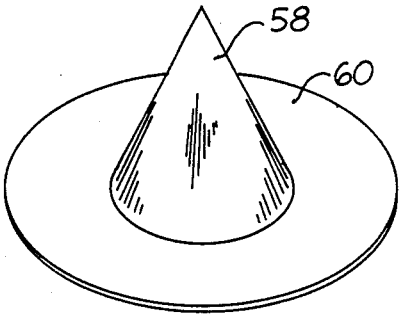
FIG. 9*a* is a perspective view of a cone-shaped boot.
Figure 9B:
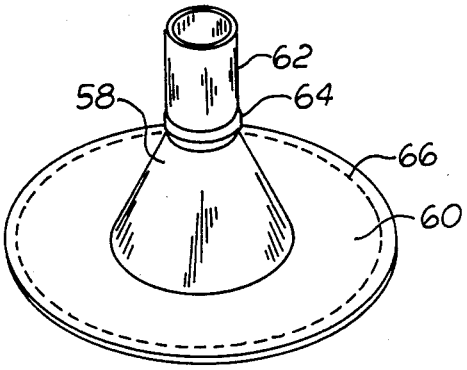
FIG. 9*b* is a perspective view of the boot cut off and engaged to an exterior pipe and its brim heat welded to the roof membrane.

In double sided roofs FIG. 8, the membrane 22 on each side of the roof is overlapped approximately 2 inches (5 cm.) as shown in FIG. 6 and heat welded together so that moisture cannot penetrate under the membrane 22.

Figure 3:
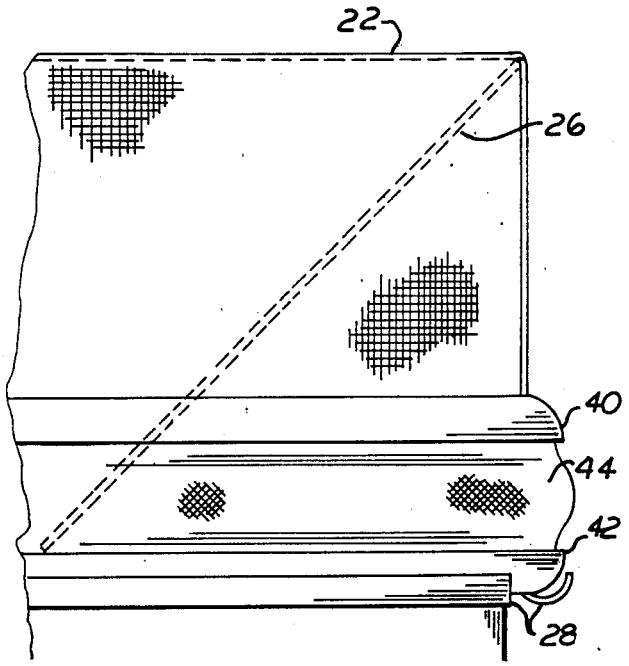
FIG. 3 is a partial perspective view of a roof corner with the membrane cover fold shown in phantom.

The membrane 22 is overlapped in the manner of a bedsheet as shown in FIG. 3 at each corner of the building. The fold line 26 provides a neat tuck in a fashion that prevents water or moisture from entering under the membrane 22.

Figure 2:
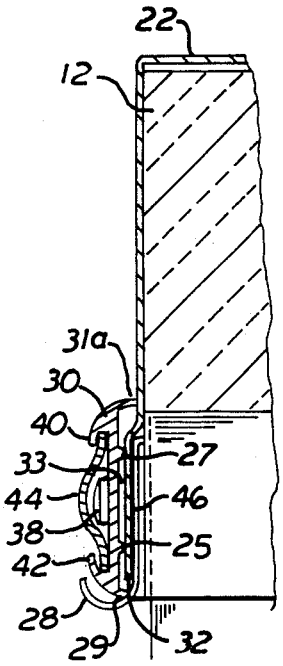
FIG. 2 is a sectional view of an alternative termination insert bar to the one used in FIG. 1.

The J rail 28 of the old roof is used as a guide to mount a termination insert bar 30 over the bottom edge 32 of the membrane 22. The termination insert bar 30 is held in place by a screw 38, having a skirt 36 and head 34. The termination insert bar has retaining legs 40 and 42 that retain a roofing member insert 44 covering the screw 38. Putty tape 46 is inserted between the membrane 22 and the J rail 28 to prevent moisture from entering the structure upon application of the screw 38 to the termination insert bar 30. Nose portions 29 and 31 together with nipples 25 and 27 of the termination insert bar 30 apply added pressure to the membrane 22 to hold the membrane in place. A void 33 is formed between nipples 25 and 27. In FIG. 2 nose 31*a* is longer than nose 29 so that void 35 in FIG. 1 does not occur and the membrane 22 is flush with the side of the rigid insulation 12.

The roofing membrane insert 44 is easily slipped under legs 40 and 42 of the termination insert bar 30 so that all screws 38 around the circumference of the roof are covered from exposure to weather.

Figure 7:
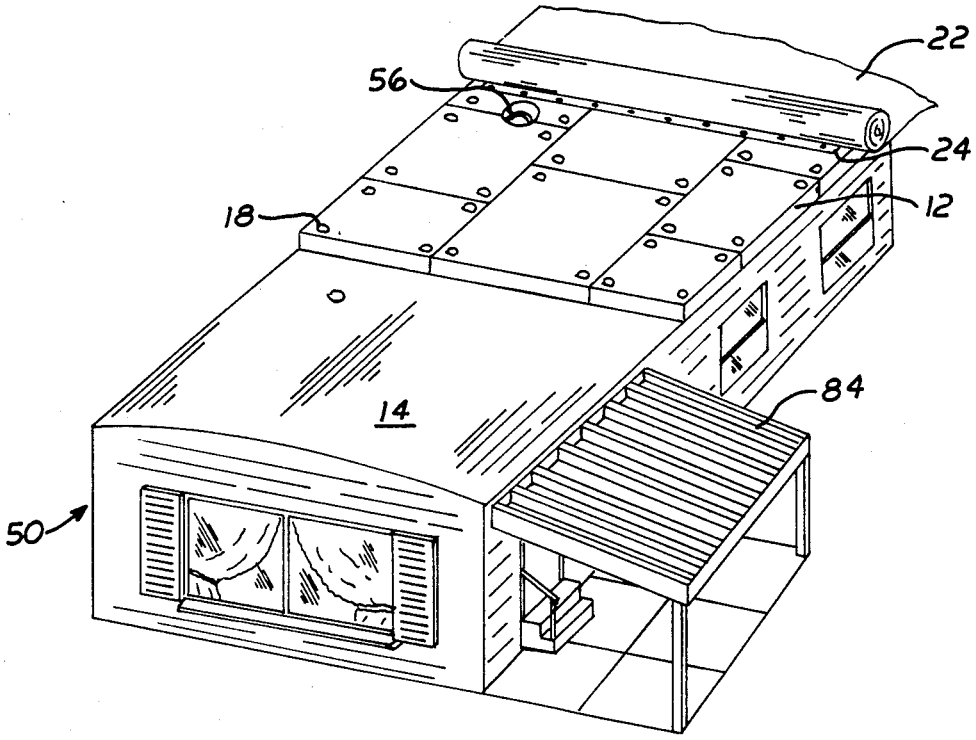
FIG. 7 is a perspective view of the roof structure being applied to a single unit mobile home.

FIG. 7 shows a single side mobile home 50 with its replacement roof in process of being installed. The insulation blocks 12 are partially in place and plates 16 holding the blocks down are visible. The membrane 22 is shown about to be unrolled. Also shown are screws 23 holding the membrane 22 in place. A double mobile home 52 is shown in FIG. 8 with the blocks 12 partially in place and the membrane 22 being unrolled over the blocks 12. The overlap zone 48 in this instance is the center portion of the mobile home 52.

As shown in FIG. 8, former stack 54 is removed prior to applying the insulation blocks 12 and a hole 56 as shown in FIG. 7 remains. Hole 56 is filled by inserting an extended pipe 62 in an inverted cone 58 as shown in FIGS. *9a* and *9b*. The outer circumference or brim 60 of the cone 58 is integral with cone 58. The top portion or apex of the cone 58 is cut off to accommodate the appropriate diameter pipe 62 inside the cone 58. A hose clamp 64 holds the cone 58 to the pipe 62 in a sealed relationship. The brim 60 integral with the cone 58 is heat welded at 66 to the membrane 22.

Figure 10:
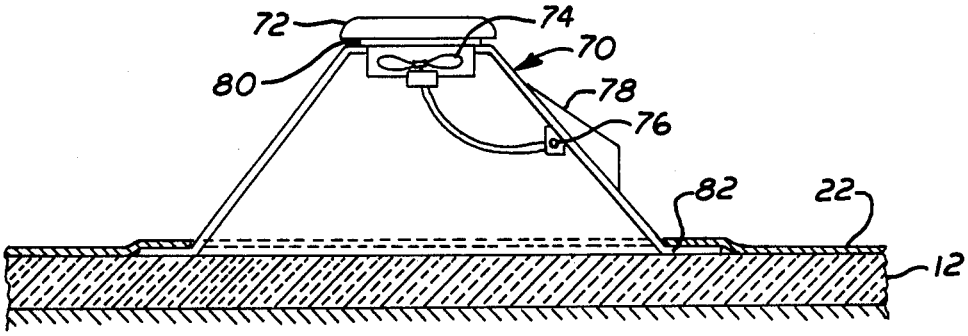
FIG. 10 is a perspective view of a power vent attached to the roof.
Figure 11:
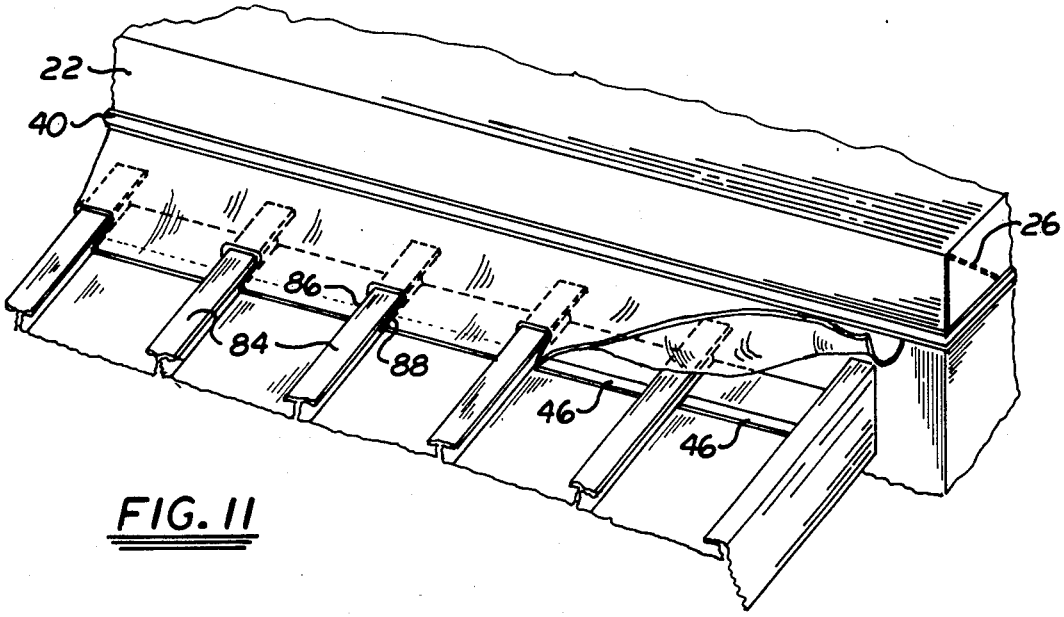
FIG. 11 is a perspective view of the roof membrane cover attachment to an awning pan.

Alternatively, a powdered roof vent 70 such as shown in FIG. 10 can be installed over insulation and through membrane 22. The power vent 70 has a cap 72, a motor and fan blade 74, a temperature sensor 76, a solar cell 78 and a one way vent 80. Air is drawn up from the interior of the newly insulated roof area through vent 80. An outer flange 82 integral with the power vent 70 is attached to the membrane 22 by heat welding.

Roof pan 84 presents a leakage problem unless carefully handled by overlapping the membrane 22 with edges 86 and 88 respectively. Putty tape such as used in FIG. 1 and designated 46 is inserted between each membrane 86 and 88 in order to form a firm seal on the pans 84.

It is preferable to use number 300 stainless steel or nickel plated screws in each instance where appropriate with this invention. The membrane is an ethylene interpolymer or like material that is heat sealable and is impervious to moisture. The insulation block 12 can be any of the materials commonly used in the industry such as styrofoam, fiberglass and the like. The exact dimension of the insulation block 12 will vary with the desired insulating effect to be obtained. The termination insert bar 30 is made of stainless steel or painted aluminum to withstand exposure to the elements.

Having thus described the invention, what we claim and desire to be secured by Letters Patent is:

1. A roof replacement structure for a building having a substantially flat roof at about right angles to the building sidewalls comprising:

(a) contiguous panels of rigid insulation applied over the flat roof and substantially covering the roof exposed flat surfaces;

(b) a flexible, water impervious membrane fastened over the panels of rigid insulation and the roof with a plurality of mechanical fasteners, the membrane having a plurality of extensions covering the mechanical fasteners, the extensions overlapping the mechanical fasteners and being heat sealed to the membrane;

(c) a periphery of the membrane overlapping the upper portion of the building sidewalls and mechanically fastened thereto with a termination insert bar having an inboard and outboard side; and (d) the termination insert bar having a first and second leg on the outboard side holding a roofing member insert and a first and second nose on the inboard side, at least one nose in contact with the periphery of the membrane overlapping the sidewall.

2. A roof structure according to claim 1, wherein the first and second nose on the termination insert bar inboard side are of substantially equal length.

3. A roof structure according to claim 1, wherein the first and second nose on the termination insert bar inboard side are of different lengths and the nose in contact with the membrane is longer than the other nose.

4. A roof structure according to claim 1, wherein a vent pipe is capped with an inverted cone with its apex cut to accommodate the pipe and a brim integral with the cone is heat sealed to the flexible membrane.

5. A roof structure according to claim 1, wherein a solar powered roof vent integral with an outer flange is affixed over the rigid insulation and through the impervious membrane and is sealed to the flexible membrane at the flange.

6. A method of repairing a flat roof at about right angles to its supporting sidewalls by:

(a) applying panels of rigid insulation in abutting relationship over all exposed flat surfaces of the roof;

(b) mechanically fastening the rigid insulation to the flat roof;

(c) covering the rigid insulation with a flexible water impervious insulated membrane;

(d) mechanically fastening the flexible membrane along multiple transverse lines to the rigid insulation;

(e) overlapping and heat sealing edges of the flexible membrane over all mechanical fasteners;

(f) overlapping the periphery of the flexible membrane along the sidewalls;

(g) mechanically fastening the flexible membrane along the sidewalls with a termination insert bar having first and second legs; and (h) inserting a strip of flexible membrane between the first and second legs to cover all exposed mechanical fasteners.

7. Method according to claim 6, wherein a hole is cut in the flexible membrane and rigid insulation to accommodate an exhaust pipe and covering the pipe with an inverted cone having an integral brim, an apex of the cone being cut to receive the pipe, and the brim of the cone being heat sealed to the flexible membrane.

8. Method according to claim 6, wherein a hole is cut in the flexible membrane and a solar powered roof vent with an integral flange is mounted over the insulation and the flange is affixed to the flexible membrane.

9. Method according to claim 6, wherein a ribbed porch roof pan is affixed to one sidewall and the flexible membrane is cut over each rib of the pan and sealed in the bottom of each pan with putty tape and sealant is applied at each rib.

10. Method according to claim 6, wherein the flexible membrane employed is an ethylene interpolymer.

* * * * *